United States Patent [19]

Erthein

[11] 3,973,705

[45] Aug. 10, 1976

[54] GARMENT CLAMPING HANGER WITH PIVOTED LOCKING CLIP

[76] Inventor: Marc Erthein, Newberry Road, East Haddam, Conn. 06423

[22] Filed: Sept. 25, 1975

[21] Appl. No.: 616,840

[52] U.S. Cl. ..... 223/96; 24/255 G

[51] Int. Cl.[2] ..... A47J 51/14

[58] Field of Search ..... 223/91, 93, 96; 24/67 R, 255 BC, 255 GP, 255 G

[56] References Cited

UNITED STATES PATENTS

| | | | |
|---|---|---|---|
| 900,625 | 10/1908 | Wallis | 223/96 |
| 1,768,005 | 6/1930 | Schwartzman | 223/93 X |
| 2,057,337 | 10/1936 | Lindeman | 223/93 |
| 3,487,984 | 1/1970 | Loscalzo et al. | 223/96 |
| 3,767,092 | 10/1973 | Garrison et al. | 223/96 |

*Primary Examiner*—George H. Krizmanich
*Attorney, Agent, or Firm*—Alexander Mencher

[57] ABSTRACT

A clamping hanger having an arm and at least one pair of hinged clamping members having at least one member integrally formed with said arm for movement of the members between open and closed positions for holding and releasing a garment or the like therebetween. The gripping members are secured in closed position by means of a locking and springable clip pivotally secured to an arm portion and swingable out of the path of movement of the movable member in any position.

10 Claims, 9 Drawing Figures

FIG. 1
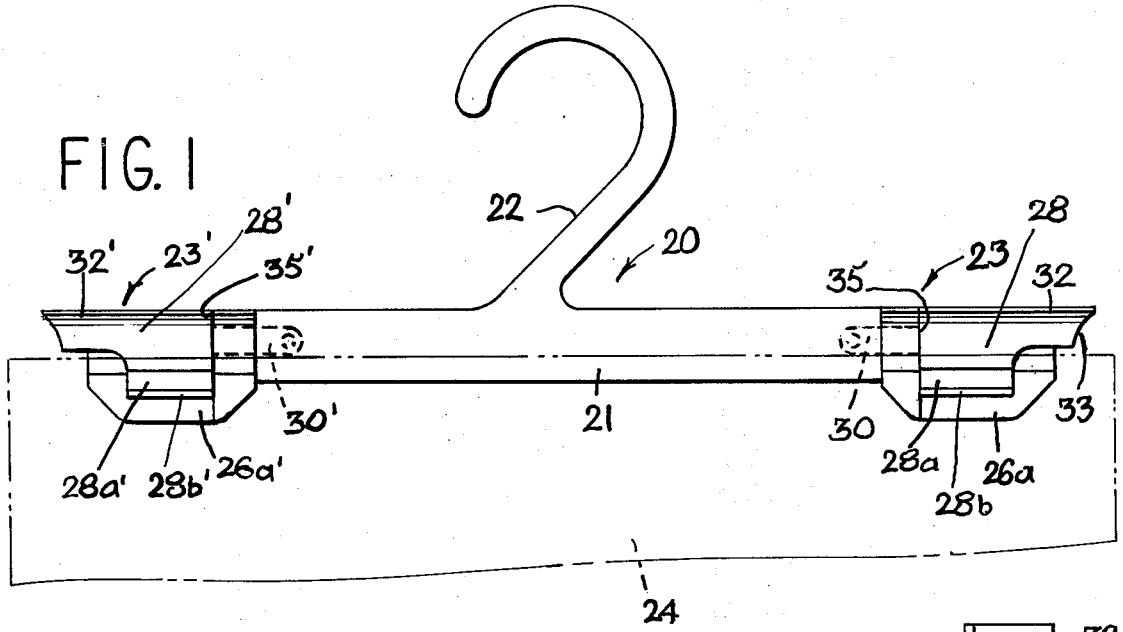
FIG. 4
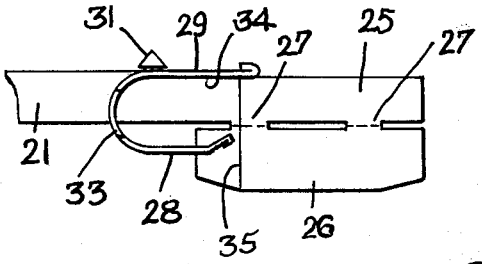
FIG. 2
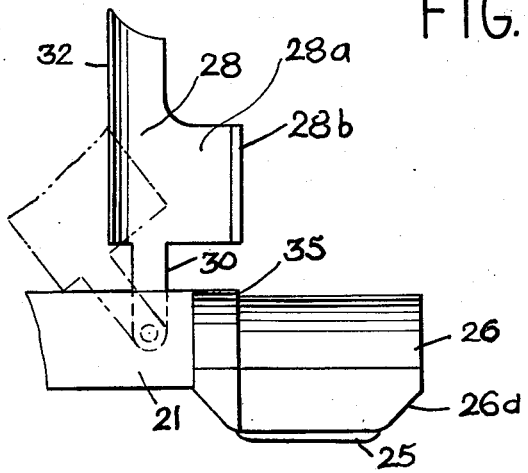
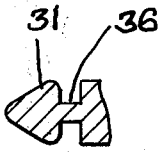
FIG. 6
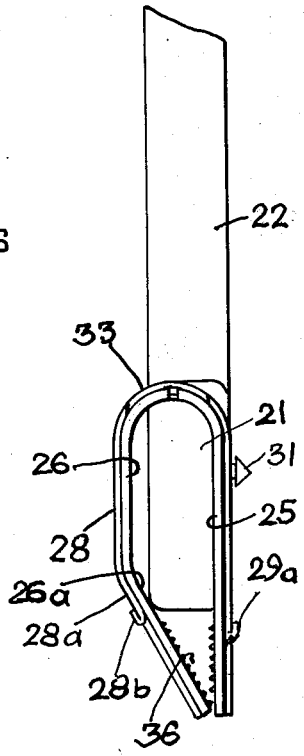
FIG. 5
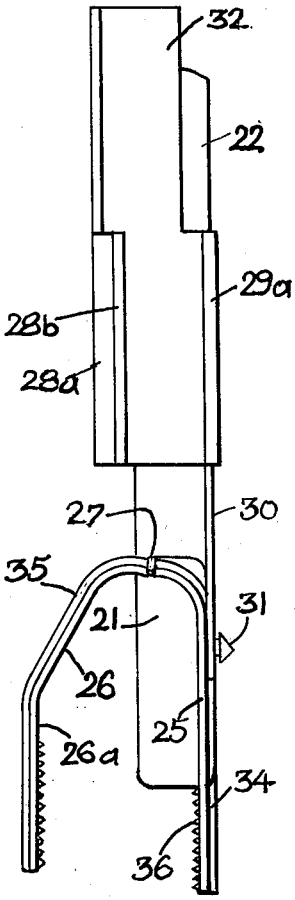
FIG. 3

GARMENT CLAMPING HANGER WITH PIVOTED LOCKING CLIP

BACKGROUND OF THE INVENTION

This invention relates generally to clamping hangers for garments and the like, and more particularly to a locking and springable clip in conjunction with hinged clamping members, said clip being pivotally attached to the hanger arm.

Clamping types of hangers are known to the art and various spring means are further known for locking the clamping members in closed position to retain garments or the like therebetween. However, there is no art known to the applicant herein wherein non-abrasive and non-metallic hinged clamping members are relatively spring-biased for locking purposes by means of a springable clip pivotally secured to an arm of the clamp and swingable away from the full path of movement of the movable clamping member when attaining any open position.

In another application filed concurrently herewith by applicant under the title Garment Clamping Hanger with Spring-Biased Clamping Members, the springable clip is directly secured to and overlies each of the clamping members and is also out of the full path of movement of the movable clamping member when attaining any open position.

In the patent to Garrison et al., U.S. Pat. No. 3,767,092 dated Oct. 23, 1973, a slidable locking clip is utilized adapted to run in tracks of hinged clamping members and which is intended to be prevented from separation by a cross-bar with the clip slidable therebeneath. In open position the clip of Garrison loosely projects above the top of the clamp, rattles and may be easily separated by being forced through the cross-bar on being snared in use or by contact. Moreover, the movable clamping member of Garrison tends to jam or separate the clip from the cross-bar when moved to fully open position; and further the mode of operation as by upward pushing of the spring slide can lead the user to confusion.

Other patents of the prior art show hinged and clamping members molded of plastic as Loscalzo et al., U.S. Pat. No. 3,487,984 dated Jan. 6, 1970, Boyce, U.S. Pat. No. 3,526,935 dated Sept. 8, 1970 and Batts, U.S. Pat. No. 3,698,607 dated Oct. 17, 1972; but each fails to show any external spring-biasing. Moreover, patents on spring-biased metallic clamps are numerous and need not be enumerated. An example is British Laurie, No. 374,312 dated June 9, 1932 relating to a paper clip.

Accordingly, a main object of the invention is to provide a garment clamp of the type having a body or arm integrally molded with one or more gripping members and adapted to receive a springable clip mounted on the arm and movable between unlocked and locked positions to hold the gripping members together.

A further object of the invention is to provide a combination of clamp and spring wherein the spring clip is operative on the clamp by virtue of pivotal mounting; wherein the spring is out of the path of movement of the movable gripping member for 180° extended position thereof; wherein operation of said clip is self-evident to the user by virtue of common knowledge of pivotal mountings of lever arms as utilized in the invention herein.

Another object of the invention resides in the efficient and economical manner of assembling the spring clip to the hanger for non-separability, in the economy in cost of production for throw-away purposes of the hanger, in the positive and easy manner for attaining locking and unlocking position and in the construction used to prevent accidental opening in the course of usage.

These objects and other incidental ends and advantages of the invention will hereinafter appear in the progress of the disclosure and as will be pointed out in the appended claims.

BRIEF DESCRIPTION OF THE DRAWINGS

FIG. 1 is a front view in elevation of one form of the invention showing the clamp of the hanger in closed position and locked by a springable clip pivotally attached inwardly of the clamp;

FIG. 2 is an enlarged and partial view in elevation showing the clip of FIG. 1 in open position;

FIG. 3 is an enlarged end view in elevation showing the clip in open position;

FIG. 4 is an enlarged and partial plan view also showing the clip in open position;

FIG. 5 is an enlarged end view in elevation as in FIG. 3 but showing the clip in closed position;

FIG. 6 is a partial sectional view of one form of pivot used to secure the clip to the arm of the hanger;

DESCRIPTION OF EMBODIMENTS OF THE INVENTION

Embodiment I

Figure 7:
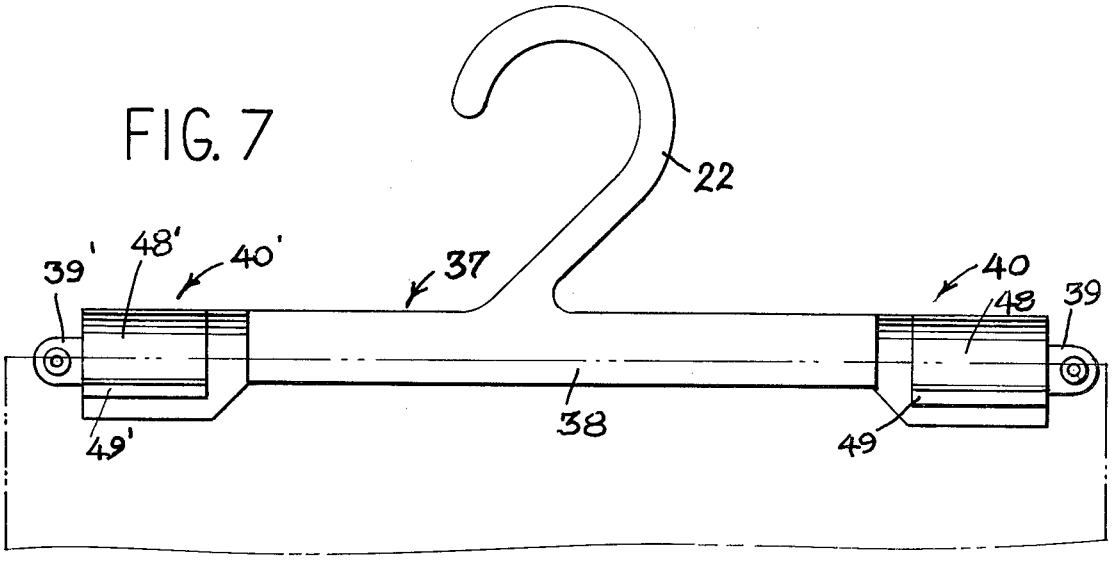
FIG. 7 is a view in elevation of another form of the invention wherein the springable clip is pivotally attached outwardly of the clamp.

In accordance with the invention and the preferred embodiments shown, the garment hanger illustrated in FIGS. 1-6 and generally designated by numeral 20 comprises a body or arm 21, a hook 22 and substantially similar right end and left end clamps generally designated by numerals 23 and 23' respectively. A garment or the like such as a pair of slacks clamped in locked position is indicated in phantom as by numeral 24.

The right clamp 23 and left clamp 23' disposed at the ends of arm 21 are identical in function but have certain structural variations because of positional difference. Accordingly, the right end clamp 23 will first be described.

Thus arm 21 at the right end thereof has a rear gripping member 25 and a front gripping member 26 hingedly secured thereto from the top to allow the relative movement of the gripping members between the open and closed position as best seen in FIGS. 3 and 5. The hinge joining gripping members 25 and 26 is shown in the form of webs 27. It is preferable that the arm 21 and clamp 23 and all parts thereof described and to be described in connection therewith be integrally mold formed from suitable resin materials including polypropylene, polyethylene and nylon and that thicknesses of parts be suitably selected for specific functions.

Arm 21 and gripping members 25 and 26 are cooperatively and suitably shaped and formed to accommodate mounting and operation of a pivoted type of spring clip for compressing and locking gripping members 25 and 26 when in operative and closed position against garment 24 therebetween, and for permitting open and spreadable position of the gripping members for release of the garment as best seen in FIG. 3 when the clip is pivoted to open position.

The pivotal spring clip utilized comprises a substantially U-shaped member in section having first and second legs 28 and 29, the latter being preferably flat and having a pivot arm 30 extending inwardly and pivotally secured to the rear face of arm 21 as on a molded securing stud 31 as will appear. The first or front leg of the clip 28 as shown is shorter than the rear leg and the lower portion thereof is inwardly offset as at 28*a* with the edge thereof outwardly turned as at 28*b* to form a tab which is adapted to fit over a lower angled or inwardly extending portion 26*a* of the front gripping member 26, all as best shown in FIG. 5. It is to be observed from FIGS. 3, 4 and 5 that the tops of front and rear gripping members 26 and 25 adjacent the webbed connection 27 are rounded and that in open position, the upper part of front gripping member is in diverging relationship with respect to the flat rear gripping member which is coplanar or coextensive with arm 21.

Leverage means are provided for pivotal movement of the spring clip and as shown consists of a clip extension 32 projecting from the clip top rounded portion and going beyond the outer extremities of gripping members 25 and 26 as best seen in FIG. 1, extension 32 having a suitable cut-out 33 for finger engagement. FIG. 3 best shows the various parts of the clip including an outwardly turned edge 29*a* of clip rear leg 29. The aforementioned spring clip as described is preferably formed of spring steel.

For avoiding protruding parts and for effecting smooth and efficient cooperation between the gripping members 25 and 26, the rear face of hanger arm 21 and the rear face of gripping member 25 are reduced in thickness to accommodate the spring clip, said reduction commencing preferably from the area of the free end of clip pivot arm 30 as best seen in FIGS. 4, 5 and 6. This reduction in thickness is indicated by numeral 34.

In addition to said reduction in thickness, a stop shoulder for the spring clip formed on the outer face of front gripping member 26–26*a*, and the outer faces of the rounded tops of said gripping member and the rear gripping member 25, said shoulder being continuous or in alignment and being indicated by numeral 35 as seen in FIGS. 4 and 5. Said stop shoulder 35 is disposed adjacent the inner edge of the gripping members and is adapted to be abutted by the inner edge of the spring clip when in closed and locked position.

The clip as shown in FIGS. 2 and 3 is in a 90° open position (in maximum extended position as shown in phantom in FIG. 2). Gripping members 25 and 26 are in normally open position and have on the inner faces suitable means for frictional gripping of a garment as projections 36 when said gripping members are compressed and locked. As the spring clip is rotated downwardly by clip lever 33, it will flex outwardly by engagement of edge 28*b* of clip tab 28*a* along the outer surface of the upper part of front gripping member 26 thereby applying an inwardly directed compressive force to hold the gripping members 25 and 26 together for holding an article. Thereafter, clip tab portion 28*a* engages lower inwardly inclined area 26*a* of front gripping member serving as detent means to hold the locking clip in a locked position. For opening purposes, lever 32 is finger engaged at 33 and rotated upwardly by a force sufficient to overcome the locking effect of engagement between spring tab 23*a* and gripping member portion 26*a*.

In closed position, the spring clip at the inner edge abuts the shoulder 35 and is disposed in overlying engagement with the outer surfaces of gripping members 25 and 26 thereby affording a positive and firm locking position with respect to torsional displacement and loosening or disengagement.

In open position, the spring clip is sturdily maintained by the connection between pivot arm 30 and stud 31. As seen in FIG. 6 stud 31 is of conic shape having a reduced collar 36 where an opening in the end of pivot arm 30 may be force-fitted thereover and rotatably engaged on said reduced collar. It is understood, however, that pivot arm 30 may be suitably and rotatably riveted to the hanger arm 21 for assembling purposes in place of the usse of molded stud 36.

The left clamp 23′ is similar to the clamp 23 above described in conjunction with hanger arm 21 except for obvious positional changes of structure. Corresponding parts to clamp 23 are referred to by the same numerals except that they are primed. Operation of clamp 23′ is similar to that of clamp 23 except for left hand operation.

Embodiment II

Figure 8:
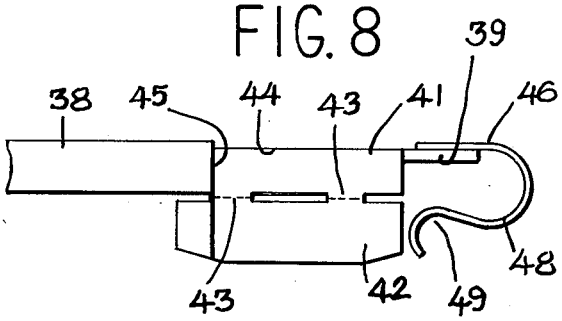
FIG. 8 is an enlarged partial plan view of the clip of FIG. 7 in open position.
Figure 9:
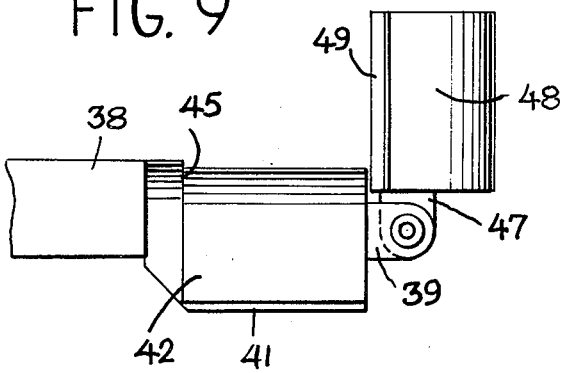
FIG. 9 is a front view in elevation of the clip of FIG. 8 in open position.

In embodiment II of the clamping hanger generally designated by numeral 37 and as shown in FIGS. 7–9, the hanger arm 38 is extended at each end as at arm portions 39 and 39′ which in effect constitute extensions of the integrally molded and coplanar rear gripping members, the gripping member of the right clamp generally designated by numeral 40 being indicated by numeral 41. As shown, ears or arm portions 39 and 39′ serve the same purpose as arm 21 for pivotally securing the spring clip of the first embodiment with modification of the positioning of the spring clip pivot arm 30 as will appear.

In the main, the difference in structure between embodiment I and embodiment II is that in the former the clamping members are each at the end of the hanger arm 21 while in the latter, the clamping members are intermediate the ends of the hanger arm 38. This difference as herein defined is also set forth in the appended claims which are so to be interpreted.

More specifically right clamp 40 has the aforementioned rear gripping member 41 and forward arched or angled front gripping member 42 hinged at the rounded tops by webbing 43. Reduction in thickness of the rear face of arm 38 or rear gripping member 41 and ear 39 is indicated by numeral 44 while the shoulder formed by reduction in thickness of the tops of gripping members 41 and 42 and the outer face of gripping member 42 to form a shoulder is indicated by numeral 45. Said reductions in thickness and shoulder are to accommodate the closed position of the spring clip which adapted to close and lock the gripping members for securing an article therebetween as in embodiment I.

The spring clip of right clamp 40 is substantially U-shaped in section and has a rear straight leg 46 having a projecting pivot arm 47 for suitable pivotal connection with ear 39 as best seen in FIG. 9. The forward leg 48 of the spring clip is curved and terminates at the lower edge in an outwardly turned lip 49 for finger engagement for opening and closing and locking the gripping members. Whereas in embodiment I, such operation is effected by operating lever 32, in embodiment II same is accomplished by said lip. Moreover, the base of lip 49 serves as the detent engaging element afforded by the lower portion of the outer face of the front gripping member 42 as best illustrated in FIG. 7.

The left clamp generally designated by numeral 40' is similar to the clamp 40 above described in conjunction with ear or arm portion 39' except for obvious positional changes of structure. Corresponding parts to clamp 40 are referred to by the same numerals except that they are primed. Operation of clamp 40' is similar to that of clamp 40 except for left hand operation.

The spring clip of embodiment II is preferably formed of steel and all other parts are similarly formed and as of the same materials as in embodiment I. Moreover, one or more clamps may be used in both embodiments and the utilization of a hanging hook of the molded fixed type or of any other type may be resorted to. In addition all parts of embodiments I and II may be suitably reinforced and be of varying thicknesses to suit requirements.

It is understood that minor changes in the materials, sizes, integration and location of parts of the illustrated embodiments of the invention may all be resorted to without departing from the spirit of the invention and the scope of the appended claims.

I claim:

1. A garment hanger comprising an arm carrying at least one clamp integrally formed therewith for suspending a garment from said clamp, said clamp having first and second gripping members, the first gripping member forming part of said arm, said gripping members being hingedly webbed to said arm along the upper edge thereof to form stationary and movable parts respectively for movement between a closed and locked article gripping position and an open and unlocked article releasing position, an inverted, two-legged and substantially U-shaped springable locking clip for said gripping members, a laterally projecting ear integral and coplanar with the rear leg of said clip and pivotally connected to said arm at the rear face of said arm and adjacent said first gripping member whereby each of the legs of said clip becomes engageable with the respective outer faces of each of the gripping members and the inverted U-portion of the clip overlies the hinged web of the gripping members when said clip is rotated over the gripping members to effect closed and locked position, said clip being movable out of the path of the movable gripping member when said member is in any open position, and means on said clip for finger engagement for operation thereof.

2. A garment hanger as set forth in claim 1 wherein one of the gripping members is arched for springing said clip when in process of attaining closed and locked position of said members and wherein at least one of the gripping members along the inner vertical edge and on the outer face has a stop shoulder for engagement of said clip along an edge area when said members are in closed and locked position.

3. A garment hanger as set forth in claim 2 wherein said gripping members are formed intermediate the arm length and said arm portion is located outside of said gripping members.

4. A garment hanger as set forth in claim 2 wherein said gripping members are formed at the end of said arm length and said arm portion is located on the inside of said gripping members.

5. A garment hanger as set forth in claim 3 wherein said clip has an upturned lip along the front lower edge of the front leg thereof for finger engagement therewith for operating said clip to open and closed position.

6. A garment hanger as set forth in claim 4 wherein said clip at the inverted U-portion thereof has a finger operating ear extending beyond the outer edges of said gripping members for operating said clip to open and closed positions.

7. A garment hanger as set forth in claim 1 wherein said clamp and arm are integrally molded from synthetic material.

8. A garment hanger as set forth in claim 7 wherein one of the gripping members is arched for springing said clip when in process of attaining closed and locked position of said members and wherein at least one of the gripping members along the inner vertical edge and on the outer face has a stop shoulder for abutting engagement of said clip along an edge area when said members are in closed and locked position.

9. A garment hanger as set forth in claim 8 wherein a hook is secured to said arm and spaced from said clamp.

10. A garment hanger as set forth in claim 8 wherein the inner faces of said gripping members each have article retaining means.

* * * * *